US010023455B2

(12) United States Patent
Leibinger

(10) Patent No.: US 10,023,455 B2
(45) Date of Patent: Jul. 17, 2018

(54) APPARATUS FOR FILLING A CONTAINER WITH A LIQUID WHICH IS INTENDED, IN PARTICULAR, FOR CONSUMPTION

(71) Applicant: Leibinger GmbH, Teningen (DE)

(72) Inventor: Benedikt Leibinger, Freiburg (DE)

(73) Assignee: Leibinger GmbH, Teningen (DE)

( * ) Notice: Subject to any disclaimer, the term of this patent is extended or adjusted under 35 U.S.C. 154(b) by 0 days.

(21) Appl. No.: 15/273,809

(22) Filed: Sep. 23, 2016

(65) Prior Publication Data

US 2017/0029258 A1 Feb. 2, 2017

Related U.S. Application Data

(62) Division of application No. 13/884,301, filed as application No. PCT/DE2012/000475 on May 9, 2012.

(30) Foreign Application Priority Data

Jun. 10, 2011 (DE) ..... 10 2011 103 876

(51) Int. Cl.
*B67C 3/22* (2006.01)
*B67C 3/26* (2006.01)
*B65B 31/04* (2006.01)

(52) U.S. Cl.
CPC ..... *B67C 3/222* (2013.01); *B65B 31/044* (2013.01); *B67C 3/26* (2013.01); *B67C 2003/2654* (2013.01); *B67C 2003/2657* (2013.01)

(58) Field of Classification Search
CPC ..... B67C 3/222; B67C 2003/2654; B67C 2003/2657; B67C 2003/2668; B67C 3/26; B67C 3/34; B65B 31/044
USPC ..... 141/59, 263, 374
See application file for complete search history.

(56) References Cited

U.S. PATENT DOCUMENTS 494,979 A * 4/1893 Dawson ..... A61J 1/2089 100/215
3,589,408 A * 6/1971 Salensky ..... B65B 31/00 141/1
3,892,264 A * 7/1975 Held ..... B67C 3/04 141/114
4,235,265 A * 11/1980 Feliks ..... B65B 55/02 141/264

(Continued)

*Primary Examiner* — Timothy L Maust
*Assistant Examiner* — Andrew Stclair
(74) *Attorney, Agent, or Firm* — Gudrun E. Huckett

(57) ABSTRACT

A liquid filling apparatus has a vertical tube with bottom opening opened and closed by a valve. The tube is insertable into a container from above and supplies liquid to the container. A flexible separating disk extends radially from the bottom end of the tube. The tube with flexible separating disk is movable toward the container bottom and air in the container escapes between peripheral rim of the separating disk and container wall as the tube moves down until the flexible separating disk rests on the container bottom. The tube with flexible separating disk then is moved upwardly so that, between flexible separating disk and container bottom, an enlarging space is formed with upward movement. Liquid is supplied into this space through the open tube opening as upward movement continues. When a targeted liquid level is reached, the valve closes and the tube is pulled from the container.

7 Claims, 18 Drawing Sheets

(56) References Cited

U.S. PATENT DOCUMENTS 4,770,214 A * 9/1988 Ginter ..... B65B 1/20
141/171
5,758,698 A * 6/1998 Kaneko ..... B65B 39/004
141/148
5,819,821 A * 10/1998 Giacomelli ..... B65B 39/001
141/114

* cited by examiner 1
2
3
4

APPARATUS FOR FILLING A CONTAINER WITH A LIQUID WHICH IS INTENDED, IN PARTICULAR, FOR CONSUMPTION

CROSS-REFERENCE TO RELATED APPLICATIONS

This application is a divisional application of U.S. application Ser. No. 13/884,301 having a filing dated of 9 May 2013, which is a national stage filing of international application No. PCT/DE2012/000475 having an international filing date of 9 May 2012 designating the United States, the international application claiming a priority date of 10 Jun. 2011, based on prior filed German patent application No. 10 2011 103 876.4, the entire contents of the aforesaid United States patent application, the aforesaid international application, and the aforesaid German patent application being incorporated herein by reference.

BACKGROUND OF THE INVENTION

The invention concerns an apparatus for filling a container with a liquid intended, in particular, for consumption, wherein a vertical tube with correlated valve is insertable into the container that is open at the top during the filling process, and wherein through the lower opening of this tube the liquid can be supplied to the container.

The filling apparatus according to the invention is in particular intended and conceived for cylindrical containers that have in comparison to the diameter of the container a very large opening. This means that the diameter of the opening is within the range of magnitude of the diameter of the container. In particular, the apparatus according to the invention is intended for filling cans or so-called wide-neck bottles.

For filling a container with a liquid intended, in particular, for consumption, in particular beverages, the liquid is supplied to the container e.g. by means of a supply tube. The problem in this context is that the liquid is exposed to ambient air or other gas with the result of undesirable gas release, gas exchange or gas introduction.

Based on this, the object of the invention is therefore to develop an apparatus for filling a container with a liquid intended, in particular, for consumption without the liquid coming into contact with an ambient gas, in particular, ambient air.

SUMMARY OF THE INVENTION

The technical solution is characterized in that in the area of the lower opening of the tube a flexible separating disk that is substantially extending in radial direction is arranged; in that the tube together with its flexible separating disk is movable in the downward direction to the lower bottom of the container such that, on the one hand, the air that is located between the separating disk and the bottom of the container upon downward movement can flow out between the peripheral rim of the separating disk and the inner wall surface of the container and that, on the other hand, in the lower end position the flexible separating disk is resting on the bottom of the container; in that, beginning with this lower position of the tube with its flexible separating disk, the tube is movable in upward direction and, at the same time, into the enlarging space that is created thereby between the flexible separating disk and the bottom of the container, liquid can be supplied through the tube by opening of the valve; and in that upon reaching the targeted filling level the valve is closable and the tube with its flexible separating disk can be pulled out of the filled container In this way, an effective apparatus is provided for filling, without contact with a gas, of a container with a liquid intended, in particular, for consumption. The apparatus is distinguished in that the liquid during the filling process does not come into contact with ambient gas, in particular, ambient air. The advantage of this device resides thus in that the liquid upon filling of the container is not subject to any gas release, gas exchange or gas introduction. Performing the filling method with the filling apparatus provides that into the container, in the most general sense, a kind of piston is inserted. This piston is comprised of a vertical tube through which, in the end, the liquid to be filled in is passed. The lower end of this tube has a flexible separating disk. It is attached inwardly seal-tightly to the tube. During the supply of the liquid, the flexible separating disk is contacting with the peripheral area the inner wall surface of the container to be filled. This means that the separating disk divides the container into two areas, i.e., an area above the separating disk which is in communication with the ambient air as well as a lower area which is completely separated during the filling process from ambient air. This is so because this lower area is delimited by the flexible separating disk, moreover by the bottom of the container as well as, finally, by the inner wall surface of container. The flexible separating disk is to be understood in the most general sense. In principle, it is a flexible structure which, as described above, divides the interior of the container during the filling process into two different areas in a seal-tight way. In this context, when the flexible separating disk is in its lower position, no air (or essentially no air) is located between the separating disk and the bottom of the container. Subsequently, the piston is moved upwardly. At the same time, the valve is opened so that liquid can flow from the tube into the container. In this context, this liquid fills exactly the space which is created upon the upward movement of the vertical tube as well as of the flexible separating disk. Accordingly, the liquid space is hermetically sealed from the air positioned above by the flexible separating disk so that the liquid cannot come into contact with the ambient air. After completion of the filling process, the afore described piston can then be completely pulled out of the container. The opening of the container can then be closed. For example, a lid is attached to the can.

According to one embodiment, the diameter of the flexible separating disk is larger than the inner diameter of the container. In this way, an absolutely seal-tight closure between the peripheral rim of the flexible separating disk and the inner wall surface of the container is provided. As a result of the flexibility, the separating disk, after the downward stroke of the piston, also has the possibility during the subsequent upward movement during the filling process to fold over while a sealing action is ensured still.

According to one embodiment, during the downward movement of the tube (after the afore described piston has been first introduced into the container before initiating the filling process), the flexible separating disk is resting with its peripheral rim on the inner wall surface of the container. As a result of the flexibility of the separating disk, the air can escape upwardly between the peripheral rim of the flexible separating disk and the inner wall surface of the container. Because of its flexibility, the separating disk can bend accordingly so that air contained in the container can laterally flow past it.

As an alternative to this, it is proposed that upon downward movement of the tube the diameter of the flexible separating disk is smaller than the inner diameter of the container. This means that during the downward movement of the tube the separating disk is moved in downward direction to the bottom of the container without contacting the inner wall of the container. In the bottom area, the diameter of the flexible separating disk must then be enlarged in such a way that it seal-tightly contacts the inner wall of the container for the subsequent filling process.

Another embodiment proposes that the flexible separating disk is matched to the bottom profile of the container. This means that the residual air between the separating disk and the bottom of the container is reduced to a minimum.

According to one embodiment, the flexible separating disk can be designed as a substantially flat single-layer body.

Another embodiment proposes that the diameter of the flexible separating disk can be adjusted. This means that, before introduction of the separating disk into the container, this separating disk has a smaller diameter than the diameter of the opening of the container as well as the inner diameter of the container in the filling area. This has the advantage that the separating disk can be introduced without problem into the opening of the container without it contacting the circumferential rim of this opening. Primarily, however, the peripheral rim of the separating disk upon downward stroke does not contact the inner wall of the container. Only in the lower position, when the separating disk is thus resting on the bottom of the container, the diameter is enlarged again such that the peripheral surface of the separating disk is resting seal-tightly on the inner wall surface of the container. After completion of filling, the diameter of the separating disk can be reduced again so that the separating disk will not contact the inner circumferential edge of the opening.

According to one embodiment, the flexible separating disk is embodied as a bellows. This bellows can be at least of a two-layer configuration. Such a bellows has the advantage that the diameter can be changed in a technically simple way. When the bellows is e.g. is lengthened, its diameter is reduced with the advantage that it can be inserted into the opening of the container or can be pulled out of the opening of the container without it contacting the circumferential edge of the opening.

For changing the diameter of the separating disk, a spiral spring is proposed that is arranged concentrically about the tube. The outer end of this spiral spring is secured in the outer area of the separating disk that is adjustable with regard to its diameter. The inner end of the spiral spring is arranged in the central area of the system and, primarily, is rotatable relative to the axis of the tube. For example, this inner end of the spiral spring can be secured on a sleeve-like tube which is concentrically arranged on the tube for supplying the liquid. When, depending on the rotational direction, the inner end of the spiral spring is thus rotated, the separating disk is enlarged with regard to its diameter and, in reverse rotational direction, is reduced. Accordingly, this spiral spring is used as an active element in order to adjust the flexible separating disk or the bellows in its diameter. In principle, this spiral spring enables to even better tension the flexible separating disk or the bellows. In this way, an improved sealing action relative to the inner wall surface of the container is provided. Moreover, by means of the spiral shape of the spring the contact pressure is distributed uniformly from the interior to the exterior in radial direction.

As an alternative to this, it is proposed that, for adjusting its diameter, the flexible separating disk is loaded pneumatically or hydraulically with overpressure or underpressure. This means that a medium is supplied to the hollow space that is enclosed by the flexible separating disk for enlarging the diameter, or the medium is removed for reducing the diameter. As a supply device or removal device for the medium, preferably an intermediate space between the central tube for the liquid and an outer tube that concentrically surrounds this tube is used. This intermediate space opens in a seal-tight way into the afore described hollow space.

Another embodiment proposes a valve of a special design. It is embodied in the form of a valve plate which is arranged at a lower end of a valve rod. This valve rod extends through the tube. The valve plate can be moved in order to open the opening, depending on the configuration, either in downward or upward direction, depending on where the correlated contact flange of the tube is positioned.

As an alternative, a float member can be provided as a valve which is disposed at the lower end of the tube.

Finally, in the area of the lower opening of the tube at least one openable as well as closable venting opening can be provided. This venting opening is opened when after filling of the container the filling apparatus is pulled out of the container in upward direction. By opening the venting opening, an underpressure cannot be produced. Likewise, upon introducing the tube into the container, the venting opening can be open in order to accelerate in this way the escape of the air that is contained in the container. In any case, the venting opening is closed when liquid is filled into the container.

BRIEF DESCRIPTION OF THE DRAWINGS

Embodiments of an apparatus for filling a container in the form of a can with a liquid intended, in particular, for consumption will be explained in the following with the aid of the drawings. They show in.

DESCRIPTION OF PREFERRED EMBODIMENTS

Figure 1:
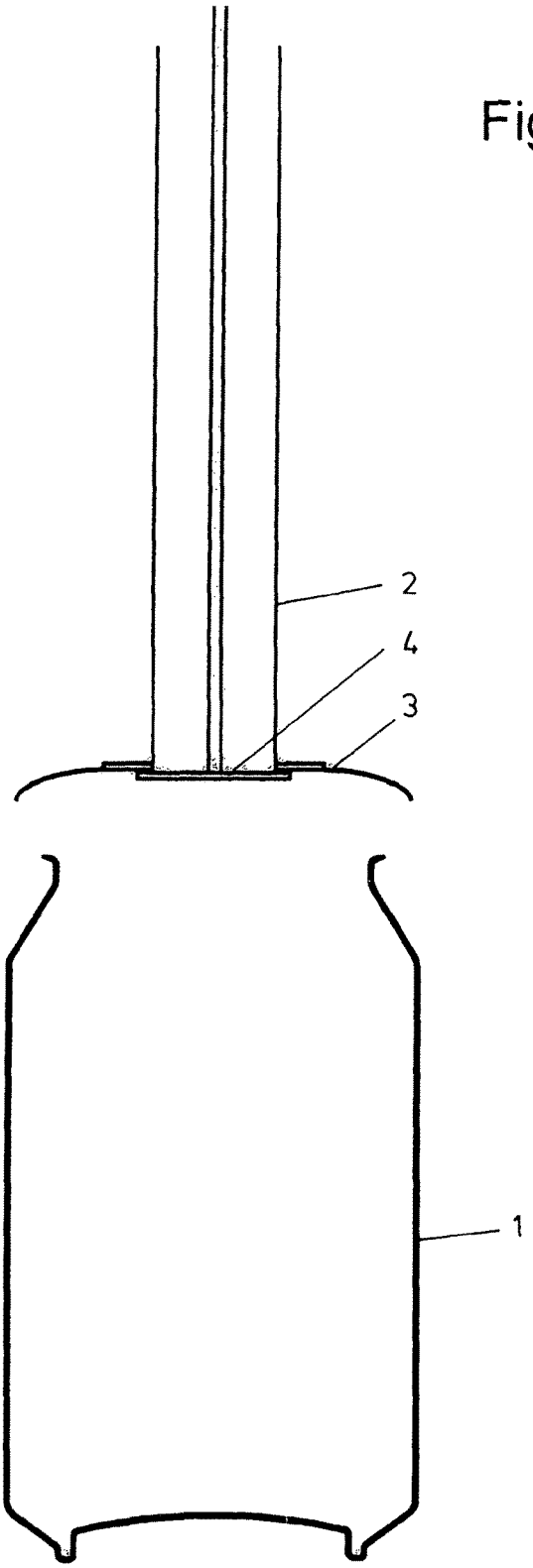
FIG. 1 a first embodiment in a schematic illustration.

The filling apparatus of FIG. 1 for filling a container 1 in the form of a can has a vertical tube 2. In the area of the lower opening of this tube 2 a flexible separating disk 3 of rubber or plastic material is arranged seal-tightly, for example, on a circumferentially extending annular flange of the tube 2. Moreover, a valve 4 is provided. The latter is comprised of a valve rod that is coaxial to the tube 2 and has a valve plate at its lower end.

Figure 2A:
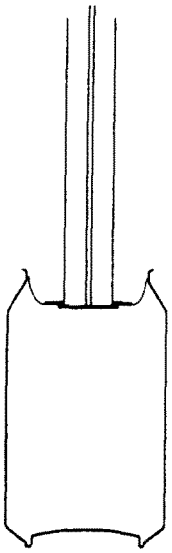
FIGS. 2*a* to 2*k* an illustration of the filling process in sequential steps with the apparatus of FIG. 1.
Figure 2B:
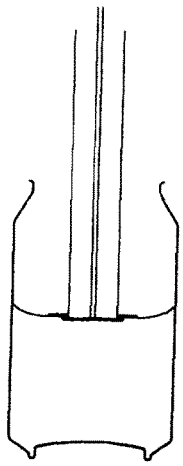
Figure 2C:
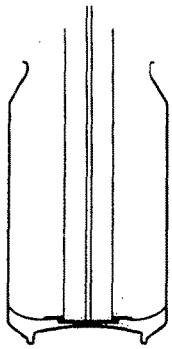

The function is as follows (compare FIGS. 2*a* to 2*j*):

Starting from the initial position as illustrated in FIG. 1, the tube 2 with its flexible separating disk 3 is moved vertically in downward direction. As a result of its flexibility, the separating disk 3 bends upwardly in the peripheral area as a result of the smaller opening diameter of the container 1 wherein between the peripheral rim of the separating disk 3 and the inner wall surface of the container 1 a sealing action is realized (FIG. 2*a*). Subsequently, the tube 2 with its separating disk 3 is moved farther downward (FIG. 2*b*) until it meets the bottom (FIG. 2*c*). During the downward movement, the air contained in the intermediate space between the separating disk 3 and the bottom of the container 1 flows out laterally between the peripheral rim of the separating disk 3 and the inner wall surface of the container 1.

Figure 2D:
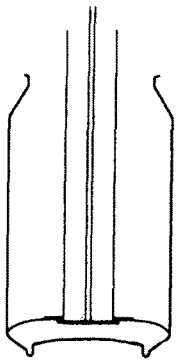
Figure 2E:
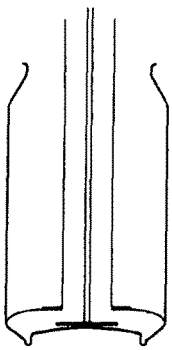
Figure 2F:
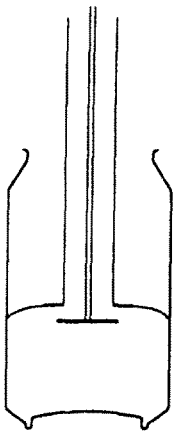
Figure 2G:
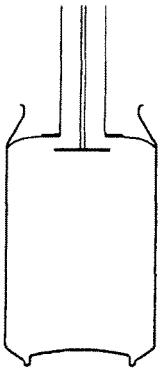
Figure 2H:
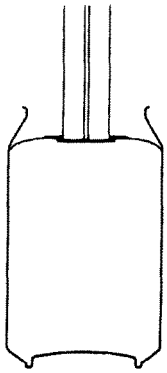
Figure 2I:
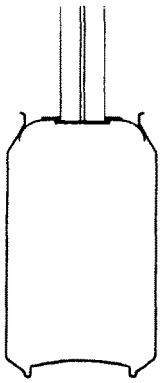
Figure 2J:
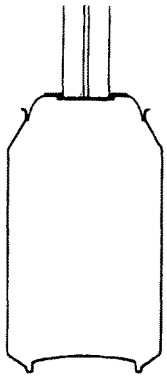
Figure 2K:
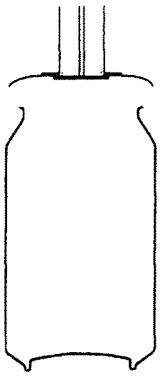

Starting from this lower position (FIG. 2*c*), the tube 2 with the separating disk 3 is then moved upwardly. In doing so, the separating disk 3 essentially folds over wherein the seal-tightness is maintained (FIG. 2*d*). While up to now the valve 4 has always been closed, it is now opened in that the valve rod with the valve plate is moved downwardly (FIG. 2*e*). In this position, liquid can now be supplied through the tube 2. The liquid escapes from the lower opening of the tube 2 and collects at the bottom of the container 1. In this context, the hollow space that is being generated is completely filled by the liquid. The tube 2 with its separating disk 3 is moved farther upwardly (FIG. 2*f*) until it has reached the opening area of the container 1 (FIG. 2*g*). After the desired filling level has been reached, the valve 4 is closed (FIG. 2*h*), the tube 2 with its separating disk 3 is moved farther upwardly (FIG. 2*i* and FIG. 2*j*) until it is completely pulled out of the container 1 (FIG. 2*k*). The filling process is thus completed and a new filling process can be started.

Figure 3B:
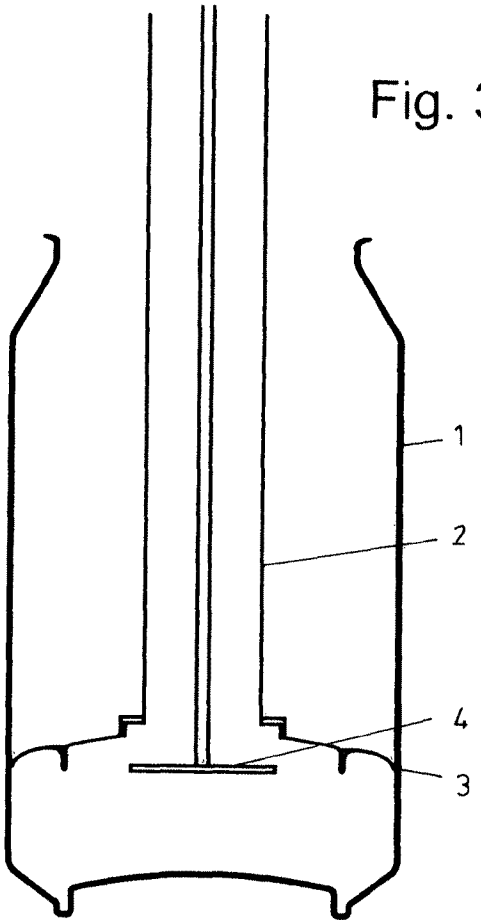
FIGS. 3*a* and 3*b* a modified embodiment of the filling apparatus with regard to profiling of the lower flexible separating disk.
Figure 3A:
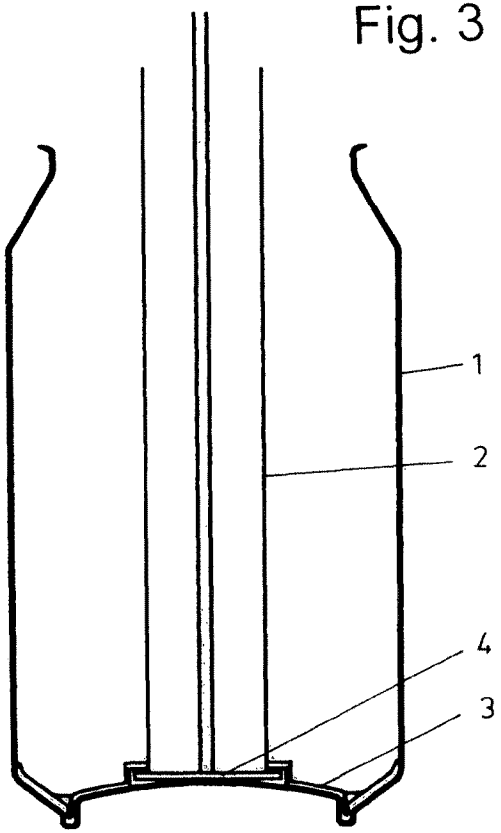

The embodiment according to FIGS. 3*a* and 3*b* differs from the preceding embodiment in that the flexible separating disk 3 has such a profile that it is matched to the bottom profile shape of the container 1. Otherwise, the process sequence is identical.

Figure 4B:
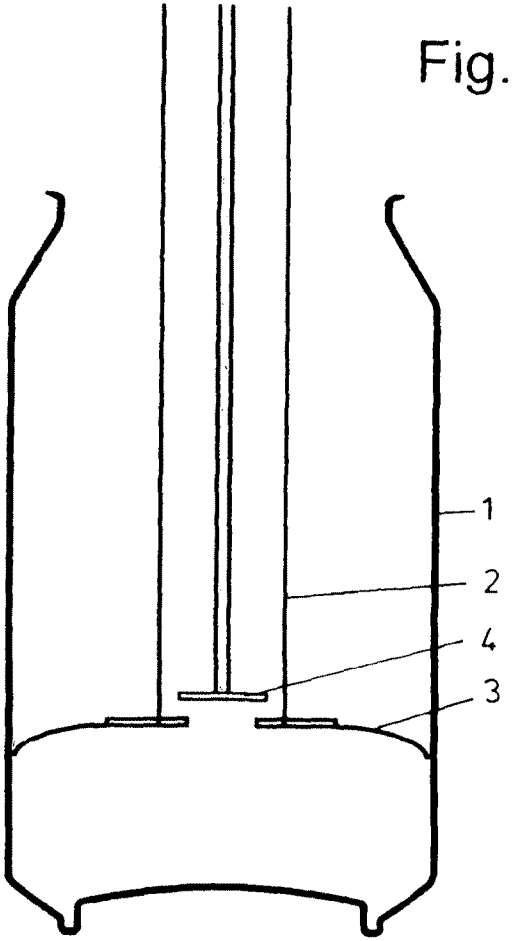
FIGS. 4*a* and 4*b* the apparatus according to FIG. 1, however with a different arrangement of the valve.
Figure 4A:
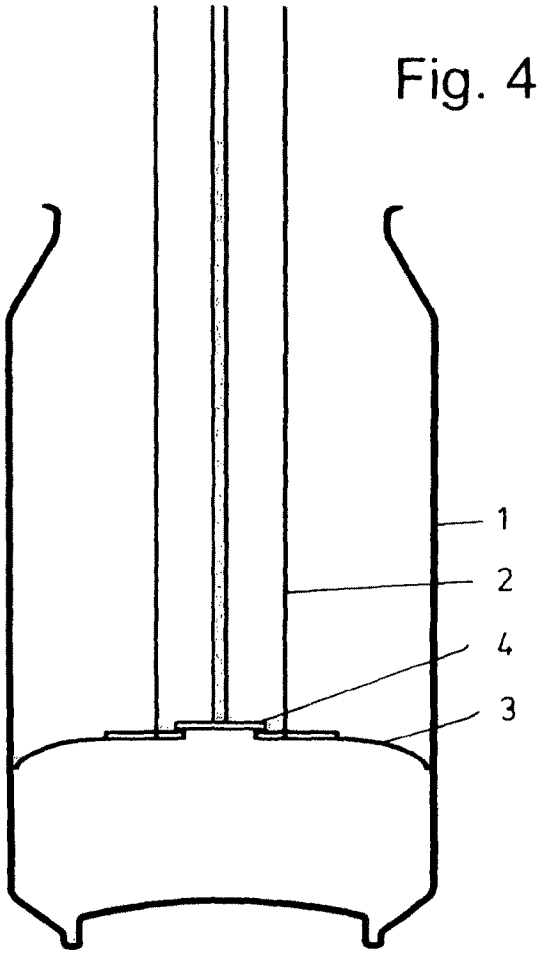

The embodiment according to FIGS. 4*a* and 4*b* differs from the embodiment of FIG. 1 in that here the valve 4 is not moved for opening with its valve plate in the downward but instead moved in the upward direction for opening. For this purpose, the lower end of the tube 2 has an appropriate sealing flange.

Figure 5B:
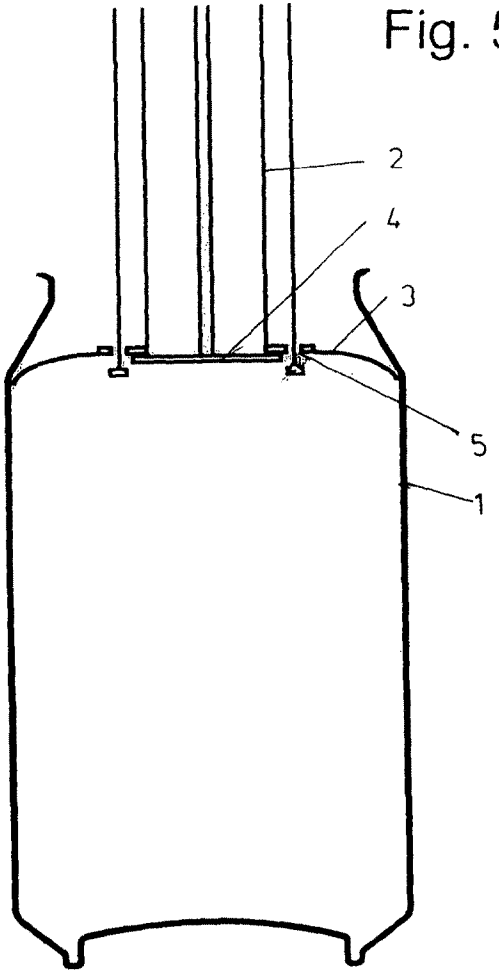
FIGS. 5*a* and 5*b* the apparatus of FIG. 1, however with additional venting action.
Figure 5A:
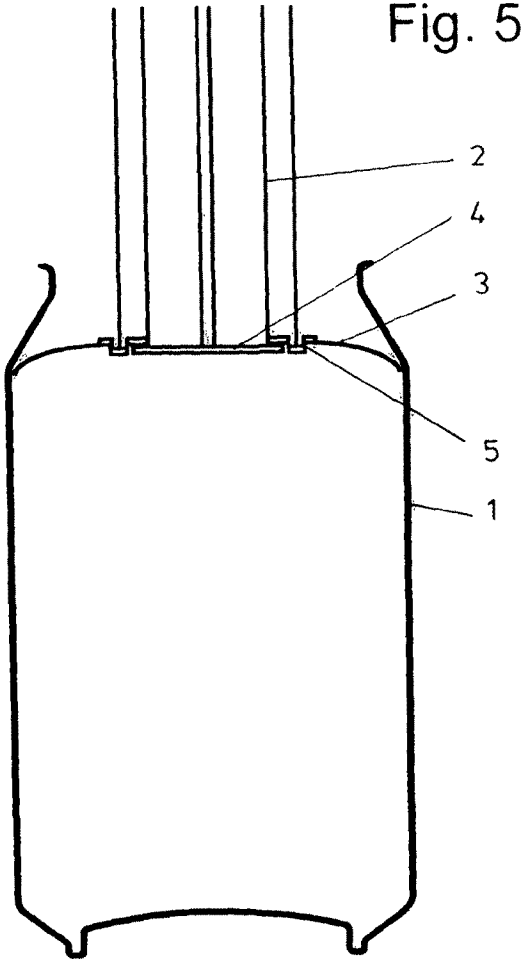

The embodiment according to FIGS. 5*a* and 5*b* is based on the embodiment of FIG. 1. The difference resides in that in addition a venting opening 5 is provided. The latter is created by means of a cylinder that is vertically movable relative to the tube 2 and upon downward movement releases the venting openings 5.

Figure 6B:
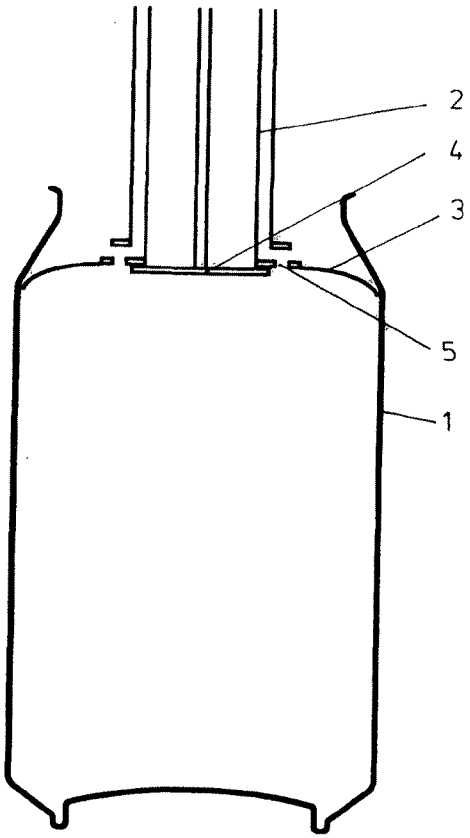
FIGS. 6*a* and 6*b* an embodiment with an alternative venting action.
Figure 6A:
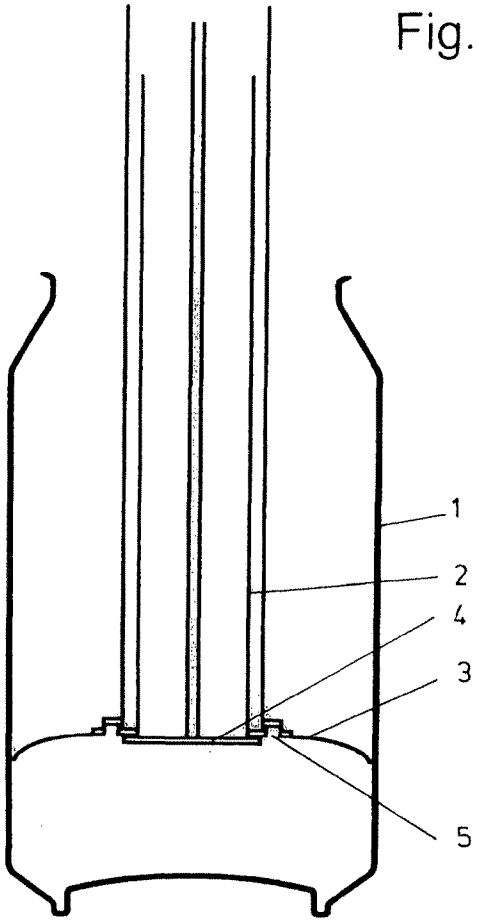

The embodiment of FIGS. 6*a* and 6*b* is based on the preceding embodiment of FIGS. 5*a* and 5*b*. Here, venting openings 5 are also provided. They are closed and opened by means of the afore described cylinder. Here, the cylinder is however movable in upward direction for opening.

Figure 7B:
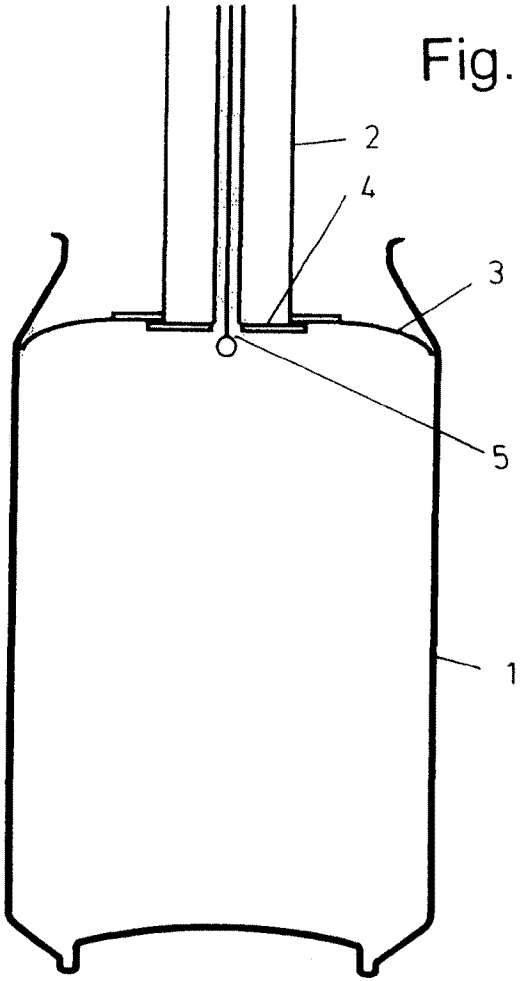
FIGS. 7*a* and 7*b* an embodiment with an alternative venting action.
Figure 7A:
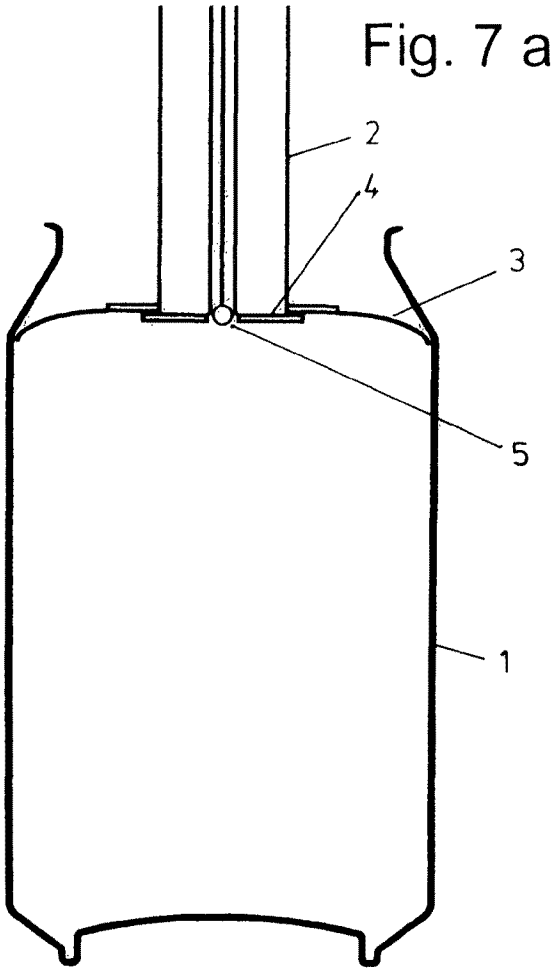

The embodiment according to FIGS. 7*a* and 7*b* has also a venting opening 5. It is formed in that the valve rod is embodied as a tube. In this valve rod tube there is a closing element, spherical in the illustrated embodiment, located at the end of a rod. The closing element is moved for opening of the venting opening 5 in downward direction.

Figure 8B:
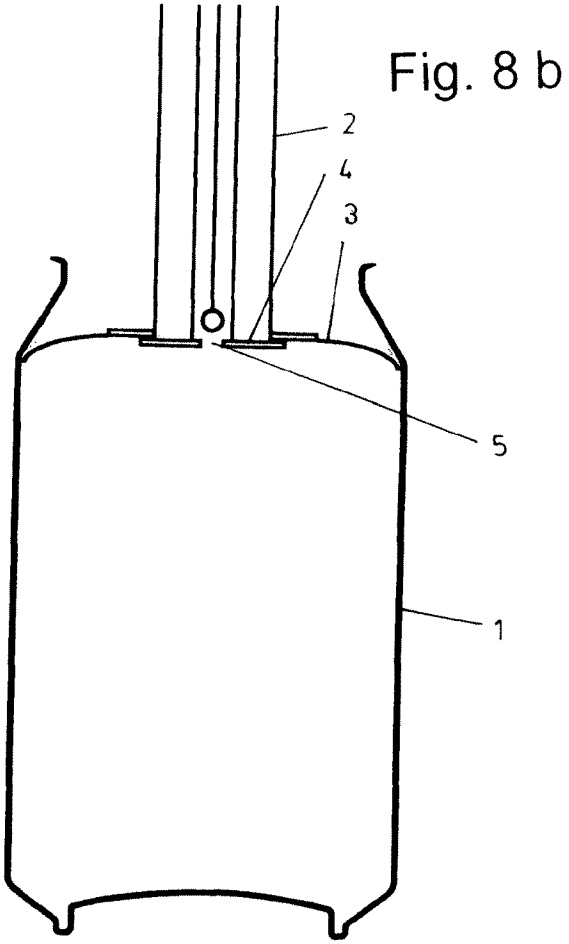
FIGS. 8*a* and 8*b* an embodiment with an alternative venting action.
Figure 8A:
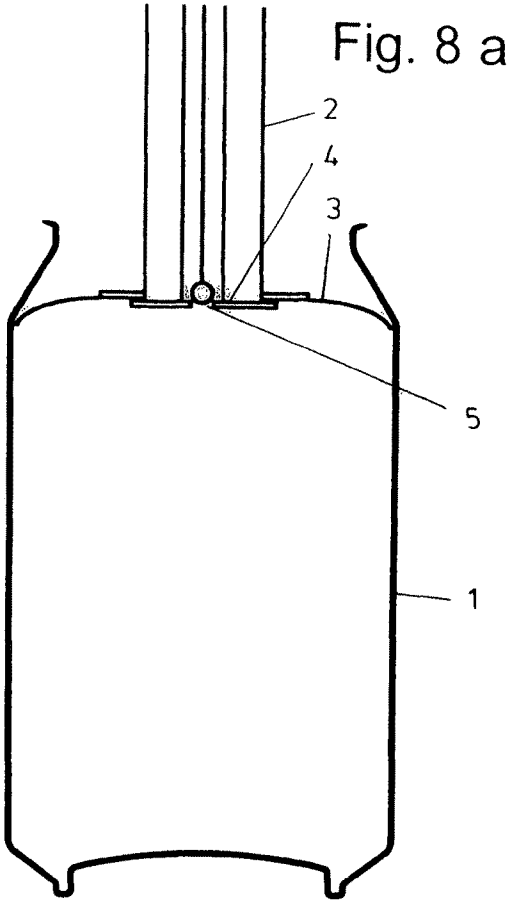

The embodiment in FIGS. 8*a* and 8*b* differs from the afore described embodiment only in that the closure ball for opening the venting opening 5 is moved upwardly.

Figures 9A, 9B, 9C:
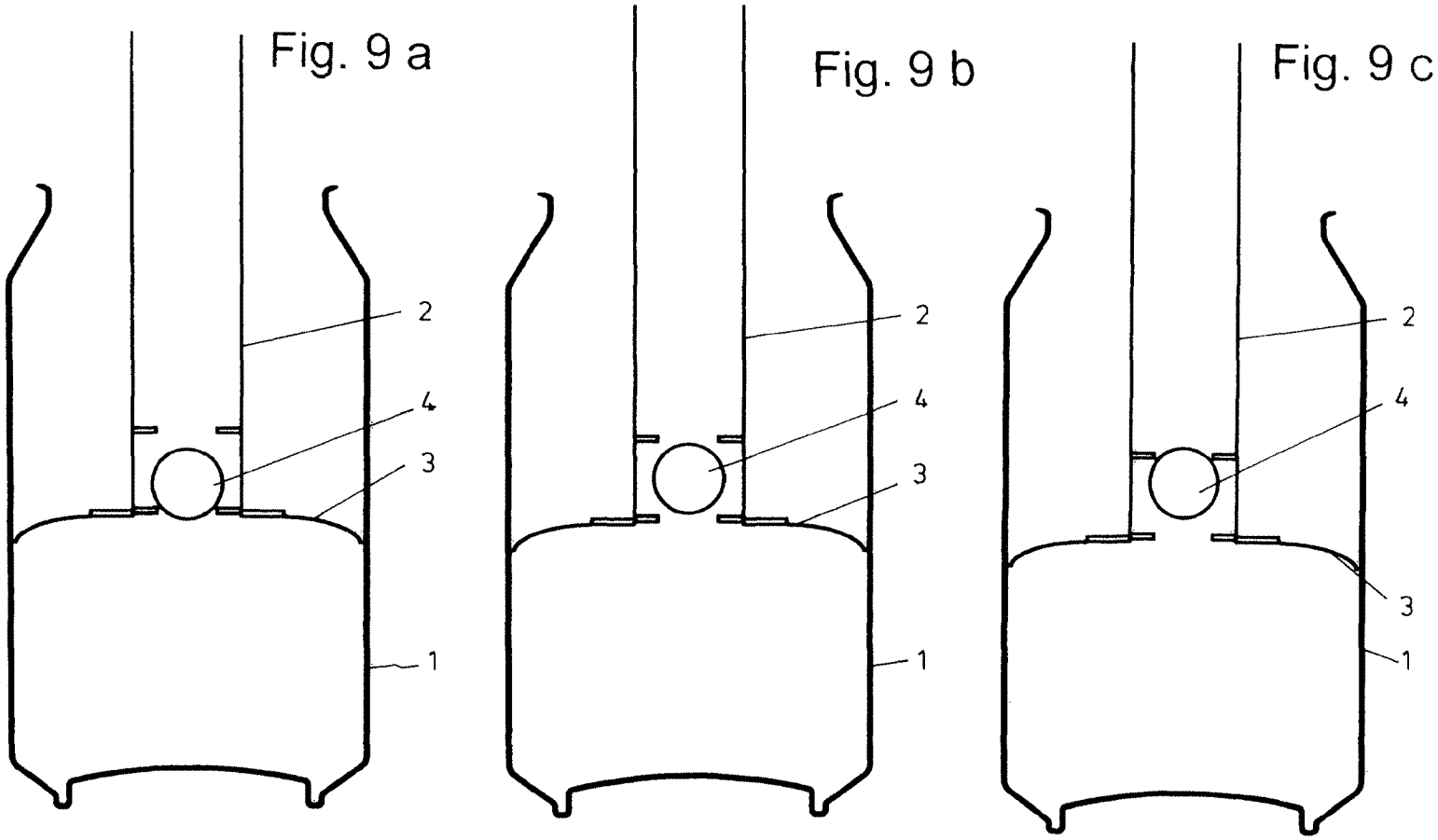
FIGS. 9*a* to 9*c* a further embodiment of the filling apparatus with a different valve arrangement.

The embodiment of FIGS. 9*a* to 9*c* shows an alternative embodiment of the valve. It is formed by a float member. It floats on the liquid to be filled in. Depending on the filling level, this float member is seal-tightly resting on the lower circumferential flange (FIG. 9*a*) or it is seal-tightly forced by the buoyance against the upper annular flange (FIG. 9*c*). The central position of the float member is illustrated in FIG. 9*b*.

Figure 10:
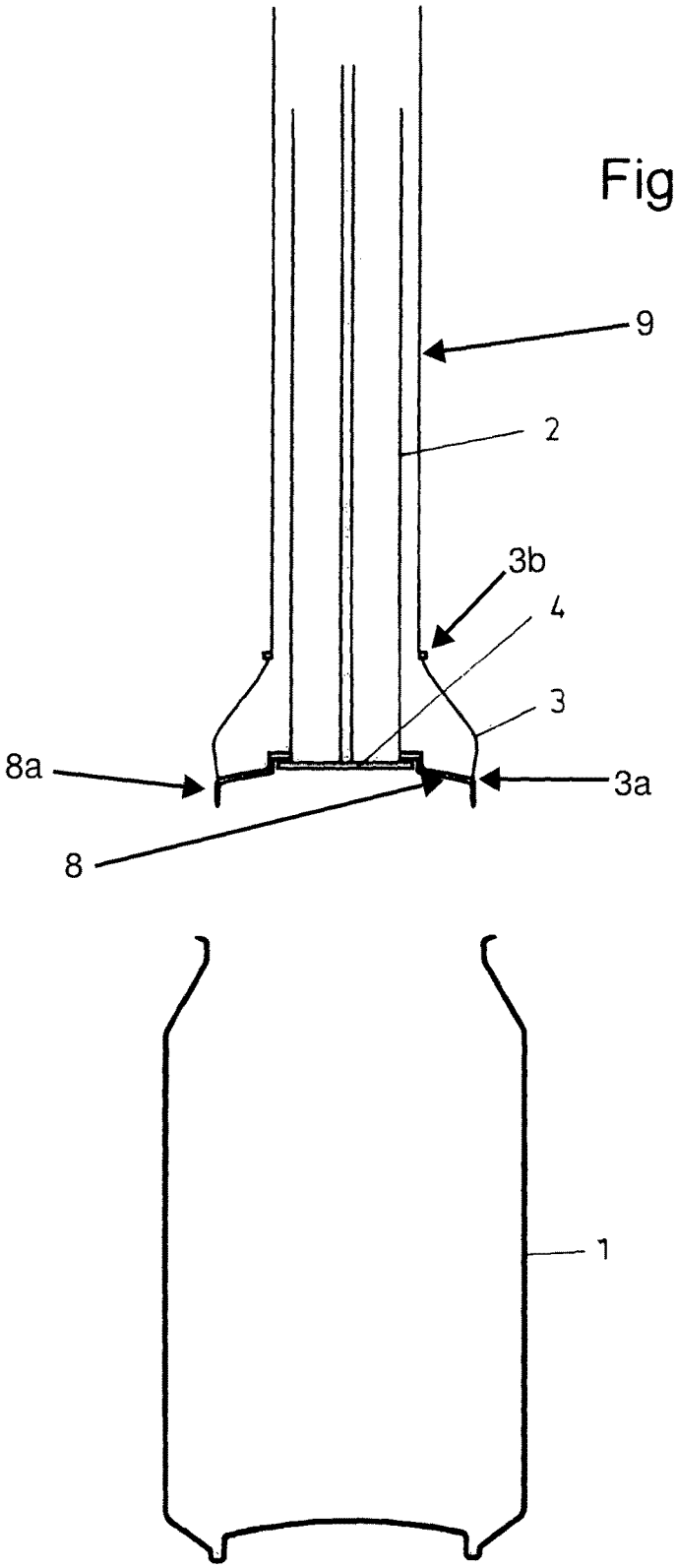
FIG. 10 an alternative embodiment in a schematic illustration using a bellows as a flexible separating disk.

The embodiment of FIG. 10 differs from the preceding embodiments in regard to the configuration of the separating disk 3. While before the separating disk 3 has been provided as a flat flexible structure, now the separating disk is an annular bellows. The latter is substantially of an annular configuration and is located on a rigid annular disk 8 which is arranged on the lower end of the tube 2. On the peripheral rim 8*a* of the rigid annular disk 8, the lower end 3*a* of the annular or hose-type bellows is arranged. By means of a sleeve 9 that is coaxial to the tube 2 the bellows, connected to the sleeve 9 with its upper end 3*b*, can be moved downwardly and in this way an expansion in radial direction can be caused (see FIGS. 11*g* and 11*h*).

Figure 11A:
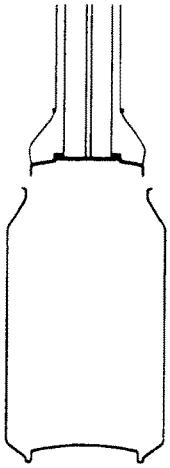
FIGS. 11*a* to 11*p* an illustration of the filling process in sequential steps with the apparatus of FIG. 10.

The function is as follows (compare FIGS. 11*a* to 11*p*):

The initial position is illustrated in FIG. 11*a*. The tube 2 with its separating disk 3 in the form of a bellows is located above the opening of the container 1. The bellows is in its contracted position, i.e., has its minimal diameter.

Figure 11B:
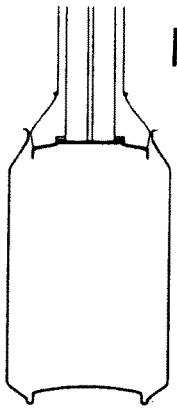

For starting the filling process, the tube 2 with the bellows is moved in downward direction. The diameter of the bellows in this context is such that it is smaller than the opening diameter of the container 1. Therefore, there is no contact taking place (FIG. 11*b*).

Figure 11C:
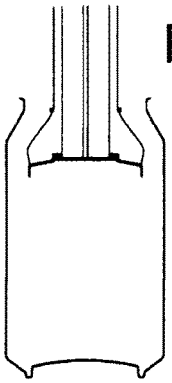
Figure 11D:
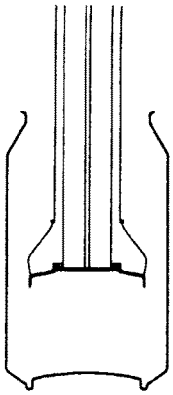
Figure 11E:
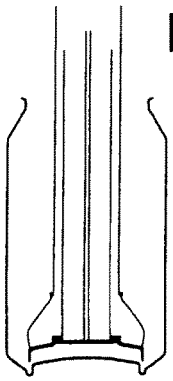
Figure 11F:
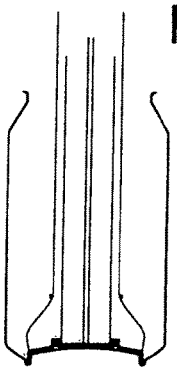

The filling apparatus is moved farther downwardly (FIGS. 11*c* to 11*e*) until the separating disk 3 in the form of the bellows contacts the bottom of the container 1 (FIG. 11*f*). This is the starting position for the actual filling process.

Figure 11G:
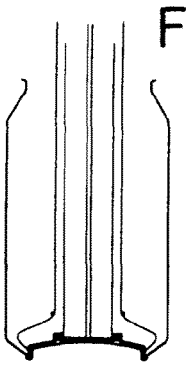
Figure 11H:
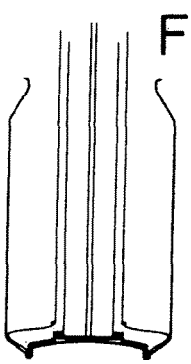
Figure 11I:
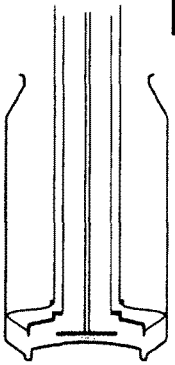

In this context, first the bellows is expanded so that it contacts seal-tightly the inner wall surface of the container 1 (FIGS. 11*g* and 11*h*).

Figure 11J:
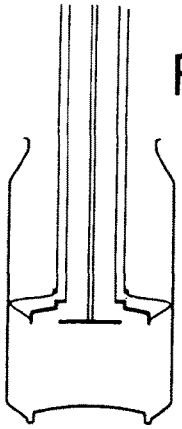
Figure 11K:
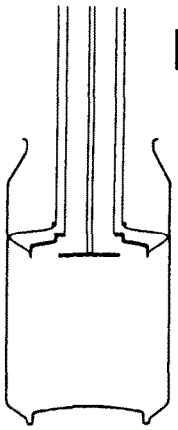
Figure 11L:
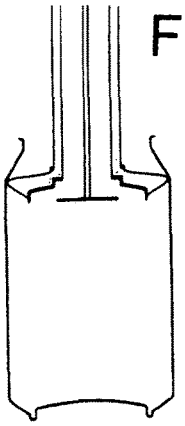
Figure 11M:
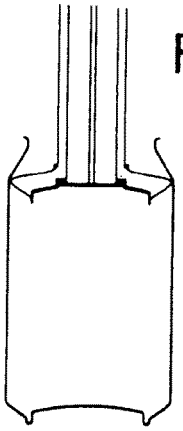

Subsequently, the tube 2 is moved upwardly. The valve 4 that has been closed up to this point is now opened (11*i*). The liquid flows through the tube 2 in downward direction and exits from the tube opening. In this context, the liquid fills the hollow space that is created by the upward movement of the separating disk 3. The tube 2 with its separating disk 3 is successively moved upwardly and liquid is supplied synchronously (FIG. 11*j* to FIG. 11*l*) until the upper filling level has been reached at which point the valve is closed (FIG. 11*m*).

Figure 11N:
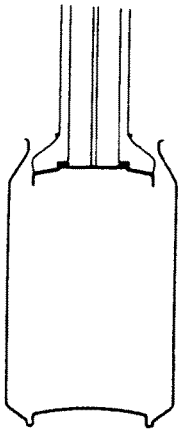
Figure 11O:
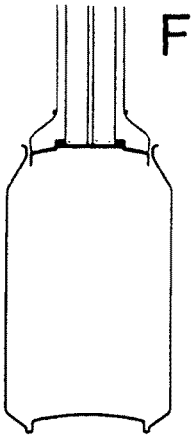
Figure 11P:
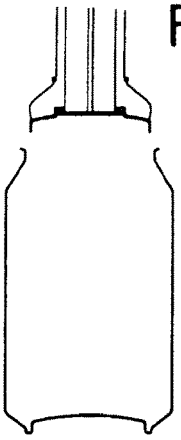

In this position, the bellows of the separating disk 3 is retracted (FIG. 11*n*) so that the tube 2 with its separating disk 3 can be moved completely out of the container 1 without there being a contact with the opening edge of the container 1 taking place (FIG. 11*o* and FIG. 11*p*).

In this way, the filling process is completed. A new filling process can be started.

Figure 12B:
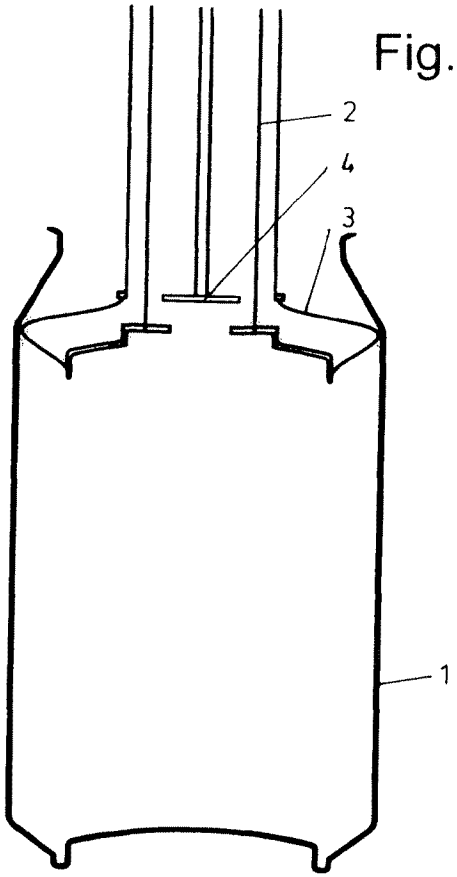
FIGS. 12*a* and 12*b* an alternative embodiment of the apparatus of FIG. 10 with a modification of the valve arrangement.
Figure 12A:
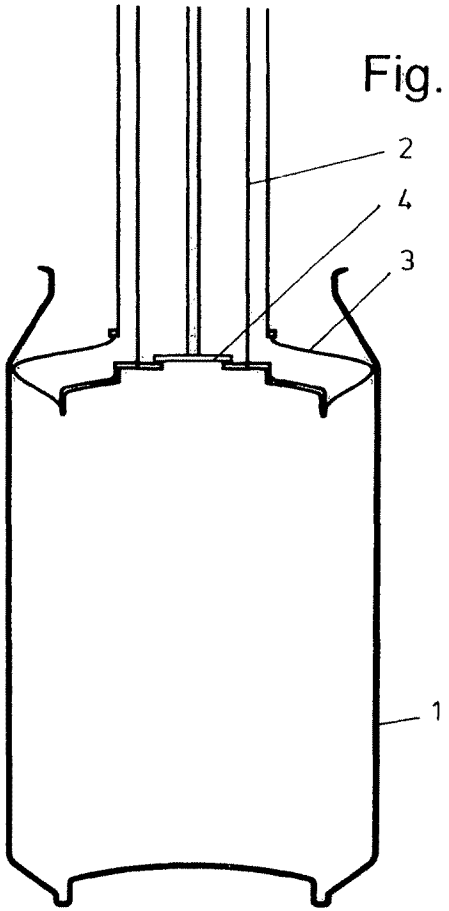

FIGS. 12*a* and 12*b* show a modified embodiment variant of the embodiment of FIG. 10. The difference resides in that here the valve plate of the valve 4 closes in upward direction and is moved upwardly for opening.

Figures 13A, 13B, 13C:
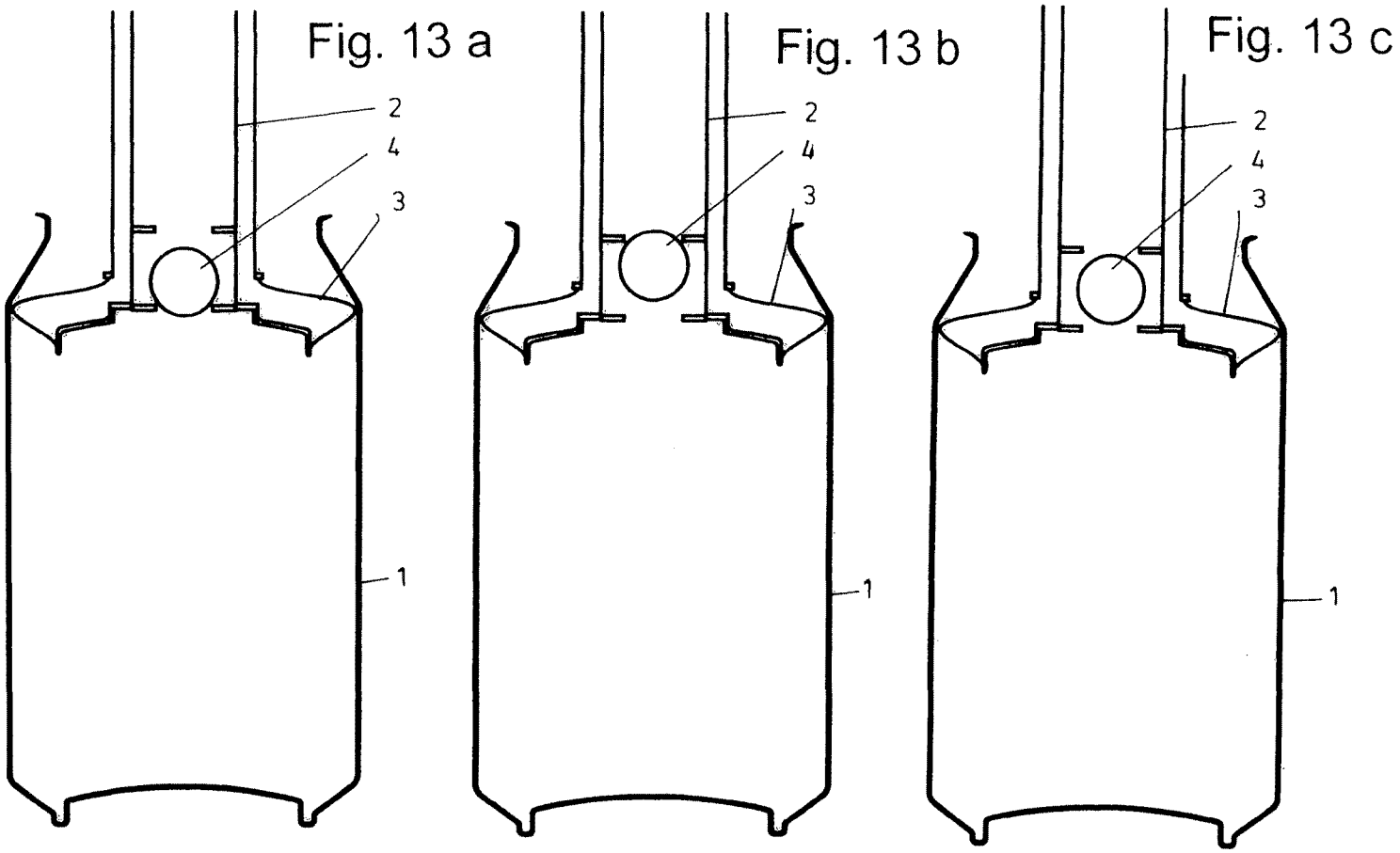
FIGS. 13*a* to 13*c* an alternative embodiment of the apparatus of FIG. 10 with a modification of the valve arrangement.

The embodiment variant in FIGS. 13*a* to 13*c* shows again the already described float member as a valve.

The embodiment as illustrated in FIGS. 14*a* to 14*e* is based on the embodiment of the flexible separating disk 3 as a bellows as has been illustrated in the embodiment of FIG. 10 as well as FIGS. 11*a* to 11*p*. This bellows is substantially of an annular configuration and is located on a rigid disk which is arranged at the lower end of the tube 2. On this peripheral rim of the rigid disk, the annular or hose-shaped bellows is then arranged. By means of a sleeve 6 that is coaxial to the tube 2 the bellows can be expanded or reduced with regard to the diameter. This is achieved in that between the afore described coaxial sleeve 6 and the bellows a spiral spring 7 is arranged as is illustrated in principle in FIG. 14*e*.

Figure 14C:
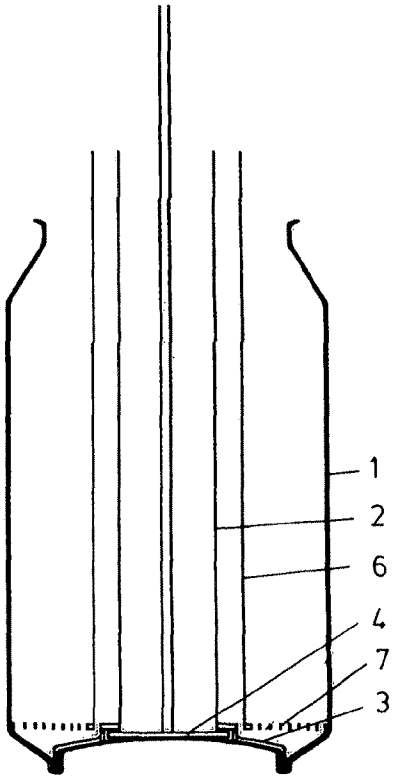
FIGS. 14*a* to 14*e* a further embodiment in a schematic illustration using a bellows with spiral spring as a flexible separating disk.
Figure 14B:
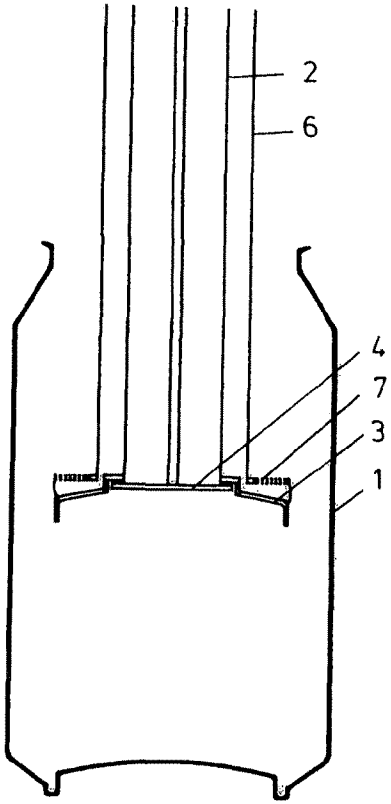
Figure 14A:
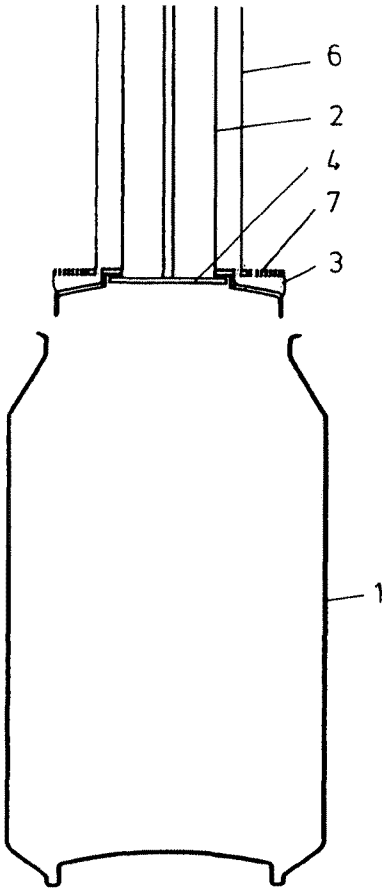
Figure 14E:
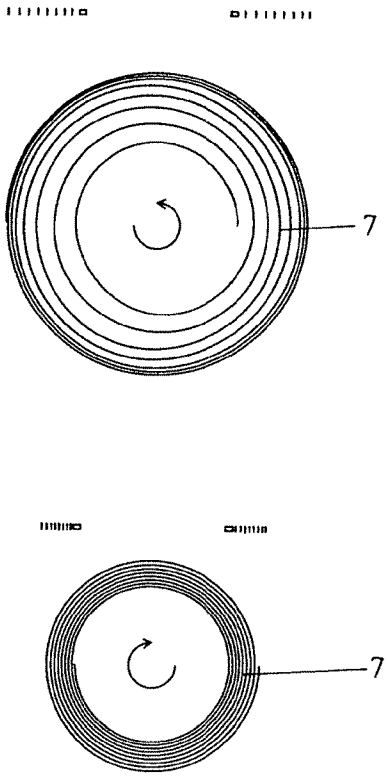

The function is as follows:

The initial position is illustrated in FIG. 14*a*. The tube 2 with its separating disk 3 in the form of a bellows is located above the opening of the container 1. The bellows is in its retracted position, i.e., has its minimal diameter. This has been achieved in that the inner end of the spiral spring by means of the sleeve 6 has been moved to the right about the center and the outer end in this context is blocked from moving on the circumference (in FIG. 14*e* the lower illustration of the spiral spring 7).

For initiating the filling process, the tube 2 with the bellows is moved in downward direction. In this context, the diameter of the bellows is smaller than the opening diameter of the container 1. Therefore, no contact takes place (FIG. 14*b*).

The filling apparatus is moved father in downward direction until the separating disk 3 in the form of the bellows contacts the bottom of the container 1. In this position, the bellows is expanded so that it contacts seal-tightly the inner wall surface of the container 1 (FIG. 14*c*). This is achieved in that the diameter of the bellows is enlarged and a radially uniformly distributed contact pressure for increasing the sealing action is generated in that the inner end of the spiral spring 7 is moved to the left about the center and the outer end is blocked from moving freely on the circumference (in FIG. 14*e* the upper illustration of the spiral spring 7).

Figure 14D:
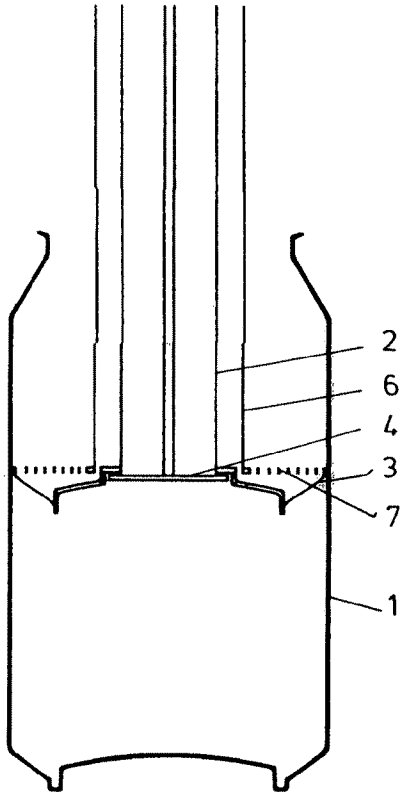

In this position, the tube 2 can now be moved in upward direction for the filling process (FIG. 14*d*). The valve that has been closed up to this point is no opened. The liquid flows through the tube 2 in downward direction and exits at the lower tube opening. In this context, the liquid fills the hollow space that is created by the upward movement of the separating disk. The tube 2 with its separating disk 3 is successively moved upwardly and the liquid is synchronously supplied until the upper filling level is reached. The valve is then closed.

In this position, the bellows of the separating disk 3 is then returned by rotation of the sleeve 6 to its minimal diameter (in accordance with FIG. 14*a*) so that the tube 2 with its separating disk 3 can be moved completely out of the container 1 without a contact with the opening edge of the container 1 occurring.

In this way, the filling process is completed. A new filling process can be started.

LIST OF REFERENCE NUMERALS

1 container
2 tube
3 separating disk
4 valve
5 venting opening
6 sleeve
7 spiral spring

What is claimed is:

1. An apparatus for filling a container with a liquid, the apparatus comprising:

a vertical tube having an opening at a bottom end;

a valve arranged at the vertical tube and adapted to open and close the opening at the bottom end;

an annular disk arranged at a bottom end of the tube, the annular disk having an outer peripheral rim;

a sleeve surrounding coaxially the tube at a radial spacing relative to the tube;

wherein the sleeve is vertically movable relative to the tube;

wherein the tube is insertable into a container that is open at a top during a filling process and wherein the tube supplies a liquid to the container through the opening at the bottom end;

a flexible separating disk disposed at the bottom end of the tube and extending in a radial direction of the tube, wherein the flexible separating disk is an annular bellows, wherein a lower end of the annular bellows is attached to the outer peripheral rim of the annular disk, wherein the annular bellows has an upper end connected to the sleeve, wherein a diameter of the annular bellows is adjustable;

wherein the tube together with the annular bellows is adapted to be moved in a downward direction to a bottom of the container such that air that is located between the annular bellows and the bottom of the container upon downward movement of the tube can flow out between a peripheral rim of the annular bellows and an inner wall surface of the container and, in a lower end position of the tube, the annular bellows is resting on the bottom of the container;

wherein the tube together with the annular bellows is further adapted to be moved, beginning with the lower end position of the tube, in an upward direction so that, between the annular bellows and the bottom of the container, a space is formed during the upward movement and is enlarged as the upward movement progresses, wherein into the enlarging space the tube simultaneous with the upward movement supplies a liquid through the opening at the bottom end of the tube that is opened by the valve;

wherein upon reaching a targeted filling level of the liquid in the container, the valve is closed and the tube with the annular bellows is pulled out of the container;

wherein the valve is configured to open and close independently of movement of the annular bellows and the sleeve, and wherein downward movement of the sleeve relative to the tube expands the diameter of the bellows.

2. The apparatus according to claim 1, wherein during the upward movement of the tube the diameter of the annular bellows is expanded so that the annular bellows seal-tightly contacts the inner wall surface of the container.

3. The apparatus according to claim 1, wherein during the downward movement of the tube the diameter of the annular bellows is smaller than an inner diameter of the container.

4. The apparatus according to claim 1, wherein the annular bellows is matched to a bottom profile of the bottom of the container.

5. The apparatus according to claim 1, wherein the valve comprises a valve rod and a horizontal valve plate connected to the valve rod, wherein the valve rod is vertically movable within the tube.

6. The apparatus according to claim 1, wherein the valve has a float member provided at the lower end of the tube.

7. The apparatus according to claim 1, wherein, near the opening at the bottom end of the tube, at least one venting opening is provided that is adapted to be opened and closed.

* * * * *